US006398072B1

(12) United States Patent
Nitta et al.

(10) Patent No.: US 6,398,072 B1
(45) Date of Patent: Jun. 4, 2002

(54) CUP DISPENSER

(75) Inventors: Hideharu Nitta; Yasuhiko Kubosaki; Kouichi Kawai, all of Tokyo (JP)

(73) Assignees: Sun Wave Corporation, Tokyo; Mitachi Ouyou Kakou Corporation, Sawa-gun, both of (JP)

( * ) Notice: Subject to any disclaimer, the term of this patent is extended or adjusted under 35 U.S.C. 154(b) by 0 days.

(21) Appl. No.: 09/158,063

(22) Filed: Sep. 22, 1998

(51) Int. Cl.[7] ..... A47F 1/08
(52) U.S. Cl. ..... 221/307; 221/308; 221/303
(58) Field of Search ..... 221/307, 308, 221/303, 221

(56) References Cited

U.S. PATENT DOCUMENTS 3,568,884 A * 3/1971 Petricek, Sr. ..... 221/310
3,581,934 A * 6/1971 Sciascia ..... 221/304
5,012,952 A * 5/1991 Franz ..... 221/36
5,014,878 A * 5/1991 Janz ..... 221/279
5,067,633 A * 11/1991 Grosz et al. ..... 221/279
5,201,869 A * 4/1993 Roethel ..... 221/304
5,427,273 A * 6/1995 Vine ..... 221/221
5,709,316 A * 1/1998 Jolly et al. ..... 221/304

* cited by examiner

*Primary Examiner*—Donald P. Walsh
*Assistant Examiner*—Rashmi Sharma
(74) *Attorney, Agent, or Firm*—Armstrong, Westerman, Hattori, McLeland & Naughton, LLP

(57) ABSTRACT

In order to offer a cup dispenser which does not require to change cylinders to meet with different cup sizes and allows to change cup sizes easily by adjusting a stopper means in accordance with various sizes of cups to be stored, and the cup dispenser is made to be composed of an outer cylinder where cups are stored, an inner cylinder fitted at the cup-outlet side of the outer cylinder and a single or plural number of springs mounted at the above mentioned outer cylinder. The outer cylinder is made of a metallic material, and the inner cylinder is made of a joint-free synthetic resin. A few cup size grooves are etched along a perimeter of the body of the inner cylinder for a free end of a spring stopper held by the above mentioned outer cylinder with the other end to be hooked and released freely. At the same time, a flange placed at the cup-outlet end of the above mentioned outer cylinder has an indication to indicate a few different cup sizes.

11 Claims, 10 Drawing Sheets

CUP DISPENSER

FIELD OF THE INVENTION

The present invention relates to a cup dispenser to take out cups and the like made of paper and a synthetic resin one by one.

BACKGROUND OF THE INVENTION

As well known, cups which are to be contained with cool drinks, frozen desserts and others, such as coffee, tea, juice and ice cream are stored in a cup dispenser D set at the front of a cabinet K as shown in FIG. 13 and FIG. 14 for users to take out one by one as needed.

By the way, as shown FIG. 15 and FIG. 16, a conventional cup dispenser is composed of a cylinder 1 in which cups C are stored and a few pawls 2 projected in along with the round side of the cylinder at predetermined intervals, every 120 degrees in the shown figure for example, at near the cup outlet of this cylinder 1, and these pawls 2 are formed to hook the rims of opening side 3 of the cups C. In this case, an index 4 in the figure is a cup weight which is to hold the stacked cups C as pressing these cups toward the outlet direction with a pressing force of springs 5, an index 6 is a flange of the cylinder for the installation and an index 7 is a lid with a rod 9 to fasten the cylinder 1 onto a supporting part 8 provided inside of the cabinet K.

On the other hand, the above cups C are available in various sizes, quantities and so on in order to accommodate with variety of types and quantities of drinks and the like contained, for example, a hot drink and a cold drink; therefore, the cylinder storing these cups must be offered in many sizes accordingly.

However, the above mentioned conventional cup dispenser D employs a fixed method in which the pawls 2 to hook and to hold the cups C are formed to project inward of the cylinder 1, so that many kinds of cylinders 1 must be prepared to meet with various cup sizes, and such circumstance creates a serious problem of inefficiency. At the same time, replacement of cups C is required because different types of drinks are offered in summer and in winter, and the cylinders 1 storing the cups suitable to served drinks must be replaced consequently; therefore, there was a problem of troublesomeness.

SUMMARY OF THE INVENTION

The present invention has been conceived on the basis of the above mentioned situation and aimed at the provision for a superior cup dispenser which does not require the users to prepare and to replace the cup cylinders in accordance with the stored cup sizes. Such cup dispenser provides easiness in handling as well as efficiency as it enables to flexibly adjust its holding means in accordance with the stored cup sizes.

Furthermore, another aim of this invention is to offer a cup dispenser of lower production cost by efficiently preventing unintended biting by springs. The cup dispenser is also user-friendly because a means for users to recognize the size status of cup setting in a moment is provided.

PRIOR ART

Figure 1:
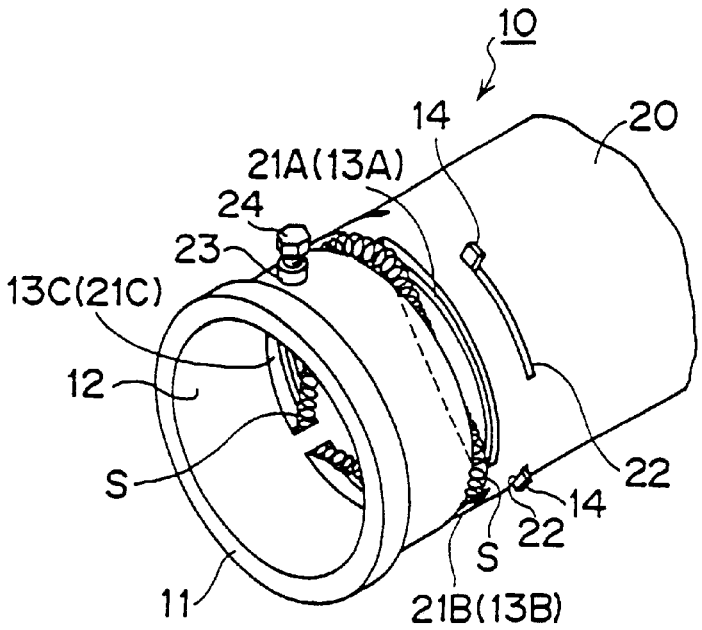
FIG. 1 is a perspective view of a cup dispenser showing a composition related to a first embodiment of the present invention.

To achieve the above-mentioned objects, a cup dispenser related to the present invention is composed of an outer cylinder to store cups, and inner cylinder formed to engage with, i.e., to project in, the cup-outlet end of the outer cylinder and a spring fitted on said outer cylinder. This cup dispenser has a characteristic that the spring is composed to elastically touch the opening rim of a cup.

More specifically, the cup dispenser related to this present invention has slits at predetermined intervals along a perimeter direction of the round body of said inner cylinder as well as has slits at predetermined intervals along a perimeter direction of the round body of said outer cylinder. A composition of this cup dispenser has a characteristic that each slit of the outer cylinder is placed to share the same axis with each slit of the inner cylinder when the inner cylinder is engaged with the outer cylinder as turning freely, i.e., is rotatably projected in the outer cylinder; and at the same time, the endless spring as an elastic media is wrapping around the outside of the outer cylinder, so that the spring engaged with each of the slits can be adjusted in terms of its amount of projection inward to the inner cylinder as turning said inner cylinder.

In this case, it is preferred to provide the body of said inner cylinder with projected fragments and a body of said outer cylinder with guide slits for the projected fragments to be freely slid in and be fitted, so that the turning operation can be further smoothly performed.

Also, in the present invention, it is preferred that said spring is to be of plural slender coil springs, and such slender coil springs are placed in a side-by-side position, and then the set of slender coil springs formed in a circle is to be engaged with said slits, so that cups are surely taken out one by one without stacking.

Moreover, in the present invention, pullout pawls are provided at predetermined intervals along the perimeter direction of the round side of said outer cylinder at its outlet end as an another tangible means to achieve the above mentioned object; therefore, it has a characteristic that the pullout paws are composed to be pressed down toward the inside of the outer cylinder by springs supported by a holder cylinder which is to interlock the outside of the outer cylinder.

Furthermore, the present invention has a characteristic to achieve the above mentioned object that said invented outer cylinder is made of a metallic material, and the inner cylinder is made of a joint-free synthetic resin. Also, at the perimeter of the body of this inner cylinder, a number of slits are etched for the free end of a spring stopper connected on said outer cylinder with the other end to be hooked selectively in accordance with sizes of stored cups. At the same time, an indication of several cup sizes is provided on the flange at the cup-outlet end of said outer cylinder.

In this case, it is preferred to provide a nonskid concave-convex surface to the outer edge of the flange at the cup-outlet end of said inner cylinder, so that the inner cylinder is prevented from slipping when it is turned in operation.

DESCRIPTION OF THE PREFERRED EMBODIMENT

Now, the present invention will be described in detail based on examples illustrated in the accompanying drawings.

Figure 2:
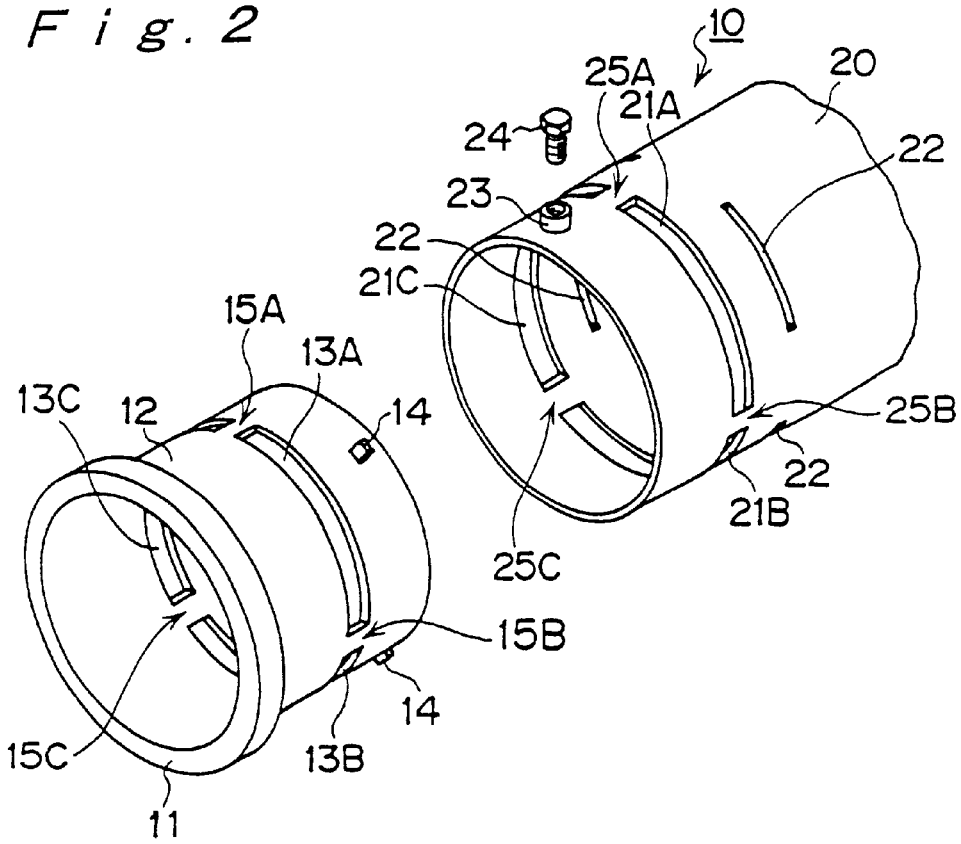
FIG. 2 is a decomposed perspective view of said cup dispenser.

FIG. 1 and FIG. 2 are showing a cup dispenser 10 related to a first embodiment of the present invention, and the cup dispenser 10 related to this embodiment is composed of an inner cylinder 11 and an outer cylinder 20 to which the body 12 of the inner cylinder 11 can be fastened freely as turning. Further, although it is not shown in the figures, cups stacked in said outer cylinder 20 are held during an ordinary state as being pressed toward the outlet direction by a force of springs. Also, the opposite end of the cup outlet of said outer cylinder 20, which is not particularly shown in the figures, is covered with a lid with a projected rod to fasten the cylinder onto a supporting part provided inside of a cabinet in the same manner as conventional cup dispensers.

The inner cylinder 11 has slits at predetermined intervals along a perimeter direction of the round side of the body 12, and, in this embodiment, a slit 13A, a slit 13B and a slit 13C are provided at every angle of 120 degrees. At the same time, at places inner than the slits, said body 12 has projections 14 at predetermined intervals which are every angle of 120 degrees in this embodiment. In here, an index 15A indicates a sheeting between the slit 13A and the slit 13C, an index 15B indicates a sheeting between the slit 13A and the slit 13B as well as an index 15C indicates a sheeting between the slit 13B and the slit 13C respectively.

On the other hand, the outer cylinder 20 has slits at predetermined intervals along a perimeter direction of the round side at its outlet end, and, in this embodiment, a slit 21A, a slit 21B and a slit 21C are provided at every angle of 120 degrees. At the same time, at places inner than the slits in said body, guide grooves 22 are provided at predetermined intervals, which are every angle of 120 degrees in this embodiment, for the projections 14 on said inner cylinder 11 can be freely slid and fitted in. In here, an index 23 of the figures is a stopper nut paired with a-stopper bolt 24 for fastening, so that the inner cylinder 11 which caliber has already been adjusted can be fixed tightly to avoid loosening by driving said bolt 24 home; therefore, the inner cylinder 11 and the outer cylinder 20 can be formed into a one body. In here, an index 25A indicates a sheeting between the slit 21A and the slit 21C, an index 25B indicates a sheeting between the slit 21A and the slit 21B as well as an index 25C indicates a sheeting between the slit 21B and the slit 21C respectively.

The inner cylinder 11 constructed as described above is to be engaged with the outer cylinder 20 as turning freely. When these are engaged, the slit 13A, the slit 13B and the slit 13C of the inner cylinder 11 and the slit 21A, the slit 21B and the slit 21C of the outer cylinder 20 share the same center axis. At this time, the projections 14 on the inner cylinder 11 are freely slid and engaged with the guide grooves 22 of the outer cylinder 20, so that the inner cylinder 11 is limited in its movement to outward.

Then, a spring S connected to form a ring shape is surrounding the outside of the outer cylinder 20 composed as described above. When the spring S is set to surround the outer cylinder, it is also fitted into said slits 13A and 21A, the slits 13B and 21B as well as the slits 13C and 21C in order to prevent it from falling off unreasonably.

Next, functions of the cup dispenser 10 composed as described above will be explained based on FIG. 3 to FIG. 5.

Figure 3:
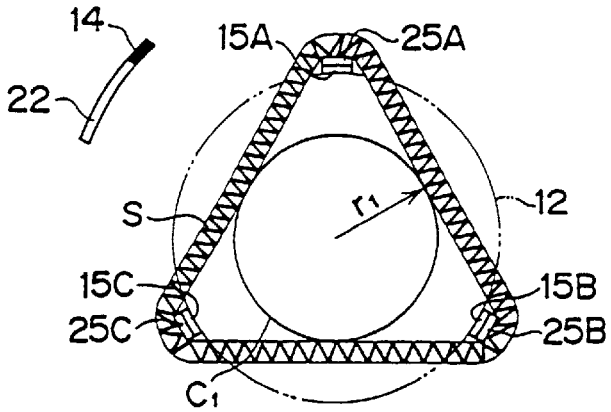
FIG. 3 is a view describing a relation between an inner cylinder, an outer cylinder and a spring which are composing said cup dispenser.

As shown on FIG. 3, the spring touches the opening rims of the cups in each of the slits, i.e., in several locations.

FIG. 3 indicates a state that, if the projections 14 of the inner cylinder 11 are in the upper end of the guide grooves 22 of the outer cylinder 20, each pair of the sheeting 15A of said inner cylinder 11 and the sheeting 25A of the outer cylinder 20, the sheeting 15B of the inner cylinder 11 and the sheeting 25B of the outer cylinder 20 as well as the sheeting 15C of the inner cylinder 11 and the sheeting 25C of the outer cylinder 20 is set to overlap each other. As a result, the above mentioned surrounding spring S becomes to form an approximate equilateral triangle.

A length of the perpendicular line from the center of the inner cylinder 11 to one side of the approximate equilateral triangle is determined as r1; therefore, cups with the same radius r1 can be stored.

Figure 4:
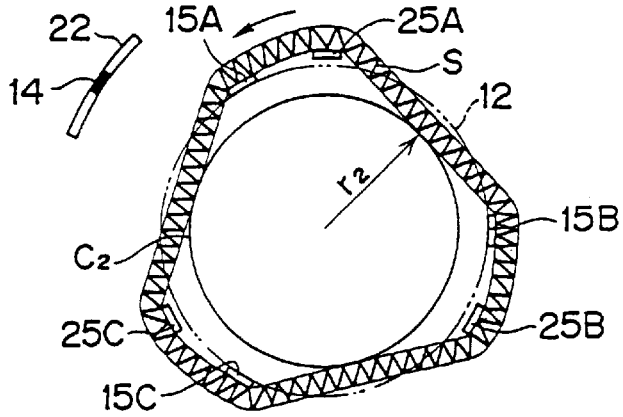
FIG. 4 is a view describing a situation of the inner cylinder, the outer cylinder and the spring when the inner cylinder composing said cup dispenser is turned in operation.

FIG. 4 indicates a state when the inner cylinder 11 is turned counterclockwise to a position that the projections 14 of said inner cylinder 11 are to be set in the middle of the guide grooves 22 of the outer cylinder 20. That means the sheeting of 15A, 15B and 15C of said inner cylinder 11 is moved from the sheetings of 25A, 25B and 25C of the outer cylinder 20 by an angle of 30 degrees respectively. Consequently, the shape of spring S is changed to an irregular hexagon, and the length of perpendicular line from the center of the inner cylinder 11 to one side of the spring S becomes longer up to r2. Therefore, cups C2 which have larger caliber than cups C1 can be stored.

Figure 5:
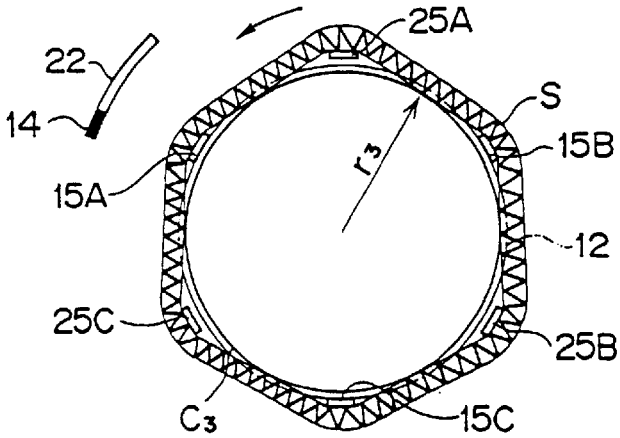
FIG. 5 is a view describing another situation of the inner cylinder, the outer cylinder and the spring when the inner cylinder composing said cup dispenser is turned in operation.

Next, FIG. 5 indicates a state when the inner cylinder 11 is further turned counterclockwise to a position that the projections 14 of the inner cylinder 11 are to be set in the lower end of the guide grooves 22 of the outer cylinder 20. In this case, the sheetings 15A, 15B and 15C of said inner cylinder 11 are moved from the sheetings of 25A, 25B and 25C of the outer cylinder 20 by an angle of 60 degrees respectively. Consequently, the shape of spring S is changed to an approximate equilateral hexagon, and the length of perpendicular line from the center of the inner cylinder 11 to one side of the spring S becomes longer up to r3. Therefore, cups C3 which have larger caliber than cups C2 can be stored.

As described above, the cup dispenser 10 related to this embodiment can be adjusted to accommodate with caliber sizes of stored cups by a simple operation as turning the inner cylinder 11.

Figure 6:
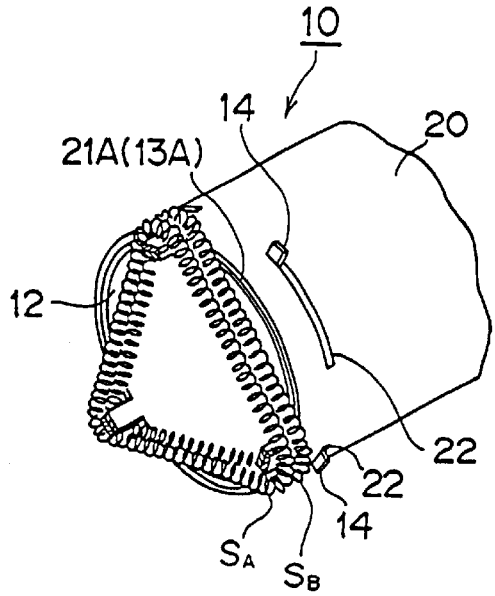
FIG. 6 is a cross-sectional perspective view of a particular portion of a cup dispenser showing a composition related to a second embodiment of the present invention.

FIG. 6 describes a second embodiment related to the present invention, and, the spring S used in the first embodiment is consisted of two slender coil springs (SA and SB) in this embodiment. These two springs SA and SB are set one over the other in a circular position as allowing the above mentioned slits 13A, 13B and 13C to engage with the slits 21A, 21B and 21C respectively; therefore, it is composed to prevent cups C set under the top cup C from being taken out together with the top cup C as making sure that either of the spring SA or SB catches an opening rim of the top cup C which is meant to be taken out. Other elements are the same as the compositions and functions of the first embodiment, so that the same indexes used for the first embodiment are provided in the figure, and the detail explanations are omitted thereof.

Figure 7:
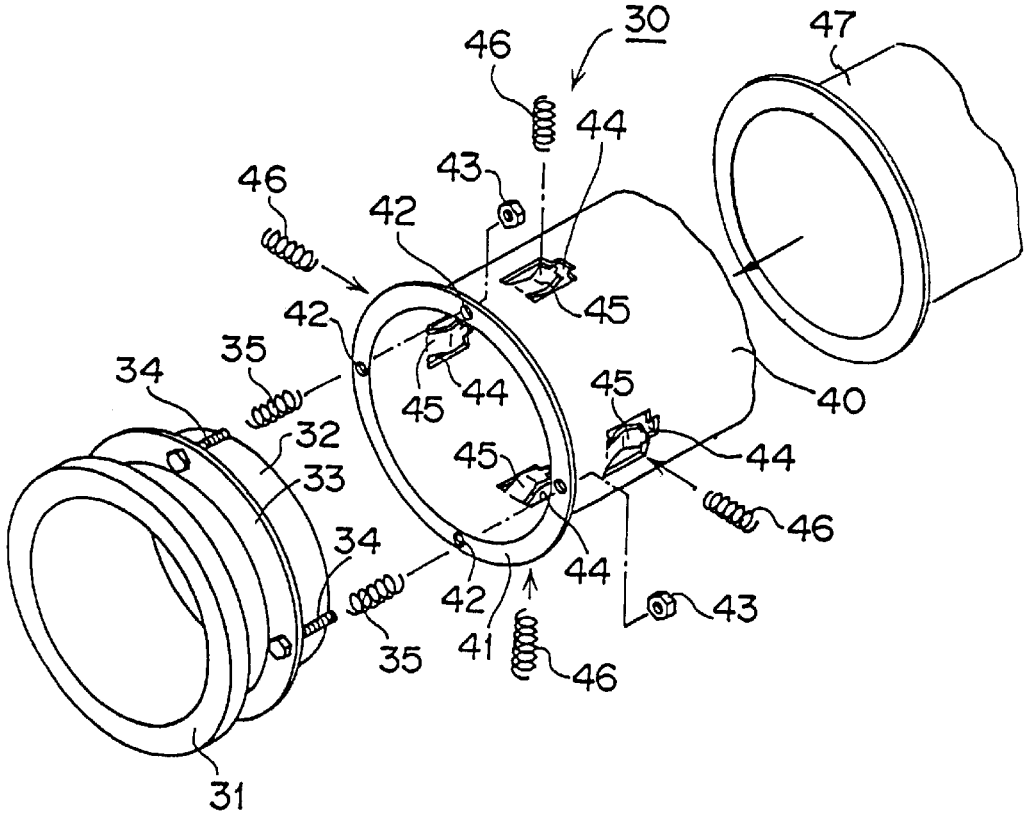
FIG. 7 is a cross-sectional perspective view of a particular portion of a cup dispenser showing a composition related to a third embodiment of the present invention.
Figure 8:
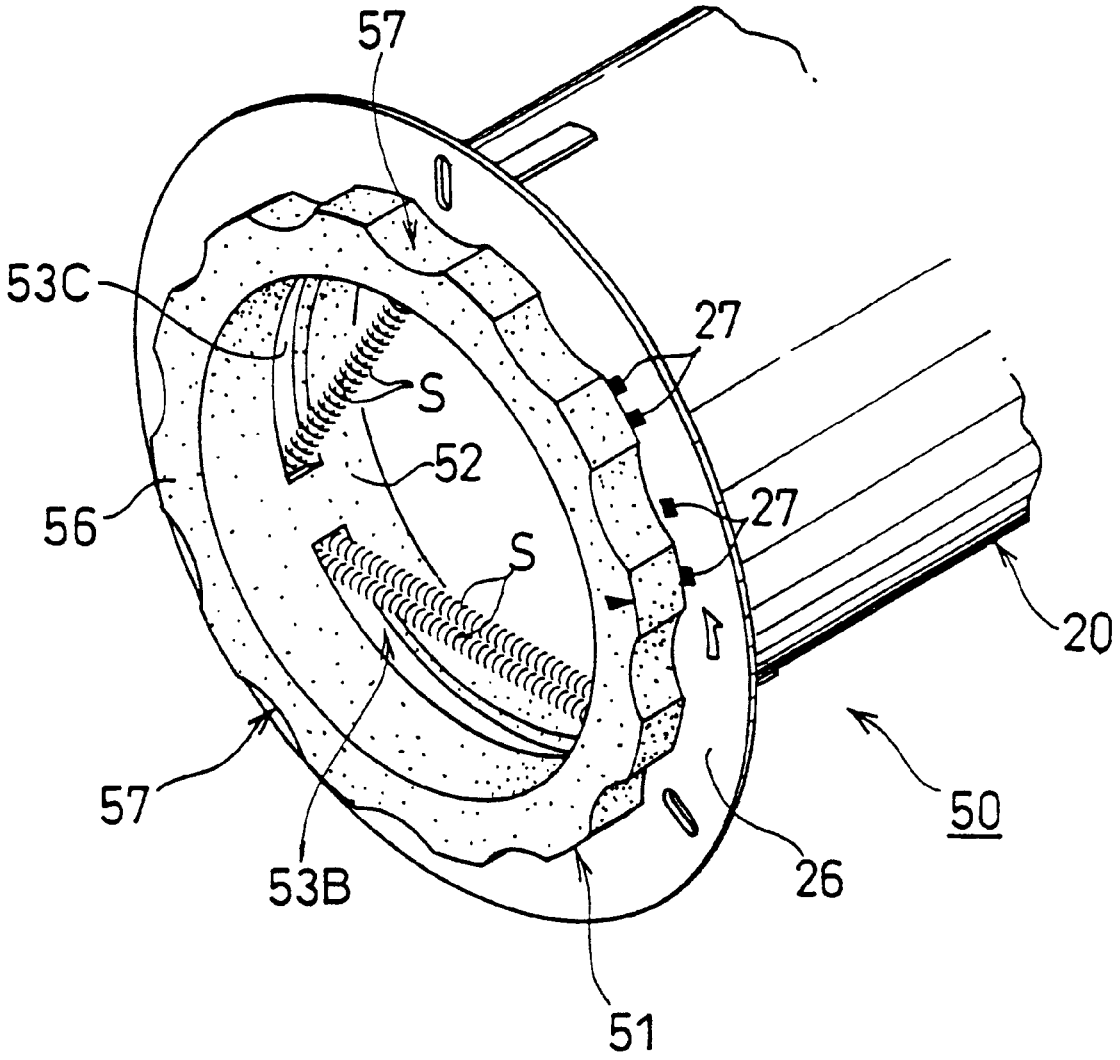
FIG. 8 is a perspective view of a cup dispenser showing a composition related to a fourth embodiment of the present invention.
Figure 9:
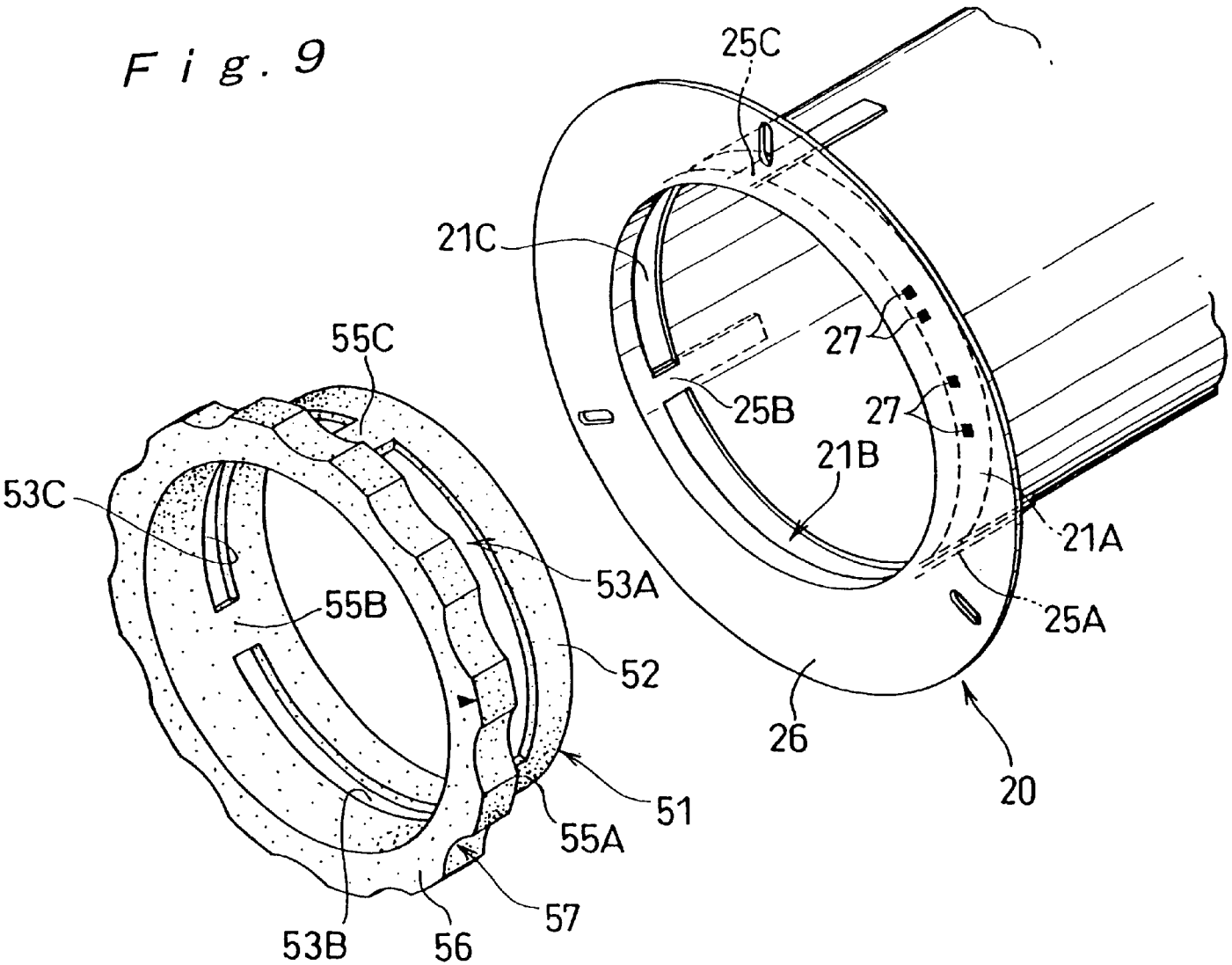
FIG. 9 is a decomposed perspective view of said cup dispenser.
Figure 10:
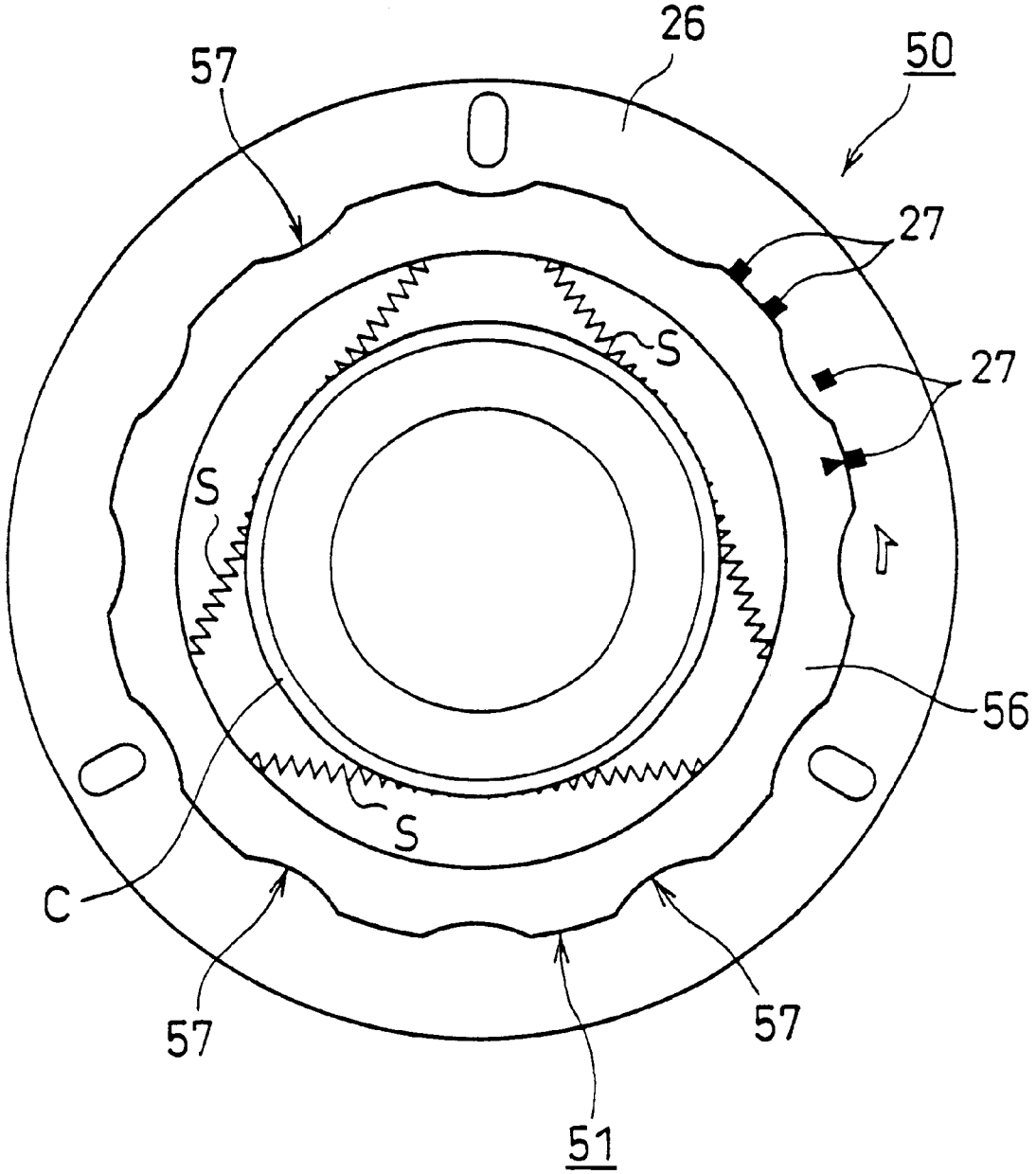
FIG. 10 is a front view of said cup dispenser.

FIG. 7 shows a third embodiment of the present invention, and a cup dispenser 30 of this embodiment consists of an inner cylinder 31, an outer cylinder 40 and a holder cylinder 47.

Said inner cylinder 31 has a projected flange 33 along its perimeter of the body, and bolts 34 are screwed down at predetermined intervals on its flange 33. In this case, an index 35 mounted on said bolts 34 are stopper springs to prevent loosening.

Also, said inner cylinder 31 and its body 32 are to be fitted into the outer cylinder 40 on which a flange 41 is extended to its edge, and bolt holes 42 are provided for each of bolts 34 of the inner cylinder 31 to be put through on the flange 41. Hence said bolts 34 are inserted into the bolt holes 42 placed on the flange 41 when the inner cylinder 31 is engaged with the outer cylinder 40, and the inner cylinder 31 and the outer cylinder 40 are fixed to make into a one body by driving the nuts 43 home tightly.

Furthermore, a required number of carvings 44, four carvings in this example, are provided along the perimeter of the body of said outer cylinder 40, and a pullout paw 45 is formed at each of the carvings 44.

Each of the pullout paws 45 which functions as a spring is bent toward the inside of the outer cylinder 40 to provide a pushing force through an assisting spring 46 because the assisting spring 46 prevents the pullout paw 45 from exhaustion. The tips of bent pullout paws elastically touch the opening of stored cup and functions to prevent the cups from falling off.

Since the assisting springs 46 are pressed and held between the holder cylinder 47 and the pullout paws 45 because of the holder cylinder 47 tightly fitted around the outer cylinder 40, the pullout paws are always pushed toward the inside of the outer cylinder 40.

FIGS. 8 to 12 indicate a cup dispenser 50 related to a fourth embodiment of the present invention, and the cup dispenser 50 related to this embodiment is composed of an outer cylinder 20 made of a metallic material such as stainless and the like to hold cups having a rim R, an inner cylinder 51 made of a synthetic resin to be fitted with the cup-outlet side 20A of the outer cylinder 20 as well as two springs SA and SB which are set at said outer cylinder.

Then a body 52 of said inner cylinder 51 has slits 53A, 53B and 53C at predetermined intervals along its perimeter; and, as described above, said outer cylinder also has slits 21A, 21B and 21C. Each of such slits 21A, 21B and 21C of the outer cylinder 20 is placed to share the same center with the slits 53A, 53B and 53C of the inner cylinder 51 respectively when the inner cylinder 51 is engaged with the outer cylinder 20 as turning freely. At the same time, the elastic endless springs SA and SB mounted on the outside of said outer cylinder 20 are fitted with each of the slits 21A, 21B, 21C, 53A, 53B and 53C; therefore, these springs do not fall off without reasons.

Also, a nonskid concave-convex surface 57 is formed on the outer edge of a flange 56 at the cup-outlet end of said inner cylinder 51 made of a synthetic resin, so that the inner cylinder 51 is prevented from slipping when it is turned in operation.

Therefore, the springs SA and SB engaged with each of slits 21A, 21B, 21C, 53A, 53B and 53C can be adjusted in terms of an amount of their projection inward to the inner cylinder 51 when the inner cylinder 51 is turned to a direction as shown with an arrow in the figure as using the above mentioned concave-convex surface 57 as a grip.

Further, on the perimeter of side 52 of said inner cylinder 51, cup size grooves 54A, 54B, 54C and 54D are etched at predetermined intervals, and to which the free end of spring stopper 60 fixed to said outer cylinder 20 with the other end can be hooked and released freely. Of course, a number of the grooves can be changed and the length of intervals can be arranged as necessary to meet with sizes of cups to be stored. Then, an index 55A in the figure indicates a sheeting between the slit 53A and the slit 53C, an index 55B indicates a sheeting between the slit 53A and the slit 53B and an index 55C indicates a sheeting between the slit 53B and the slit 53C respectively. Also, sheetings on the outer cylinder 20 accommodating with these sheetings 55A, 55B and 55C consist of a sheeting 25A between the slit 21A and the slit 21C, a sheeting 25B between the slit 21A and the slit 21B and a sheeting 25C between the slit 21B and the slit 21C.

Moreover, in accordance with positions where the spring stopper 60 join with said cup size grooves 54A, 54B, 54C and 54D, an indication 27 to indicate several cup sizes, such as 7 ozs, 10 ozs, 12 ozs, 14.18 ozs and so on, is provided on a flange 26 attached on the cup-outlet side of said outer cylinder 20 to extend its caliber. OF course, the indication can be printed or etched in accordance with sizes of cups to be stored.

Figure 11:
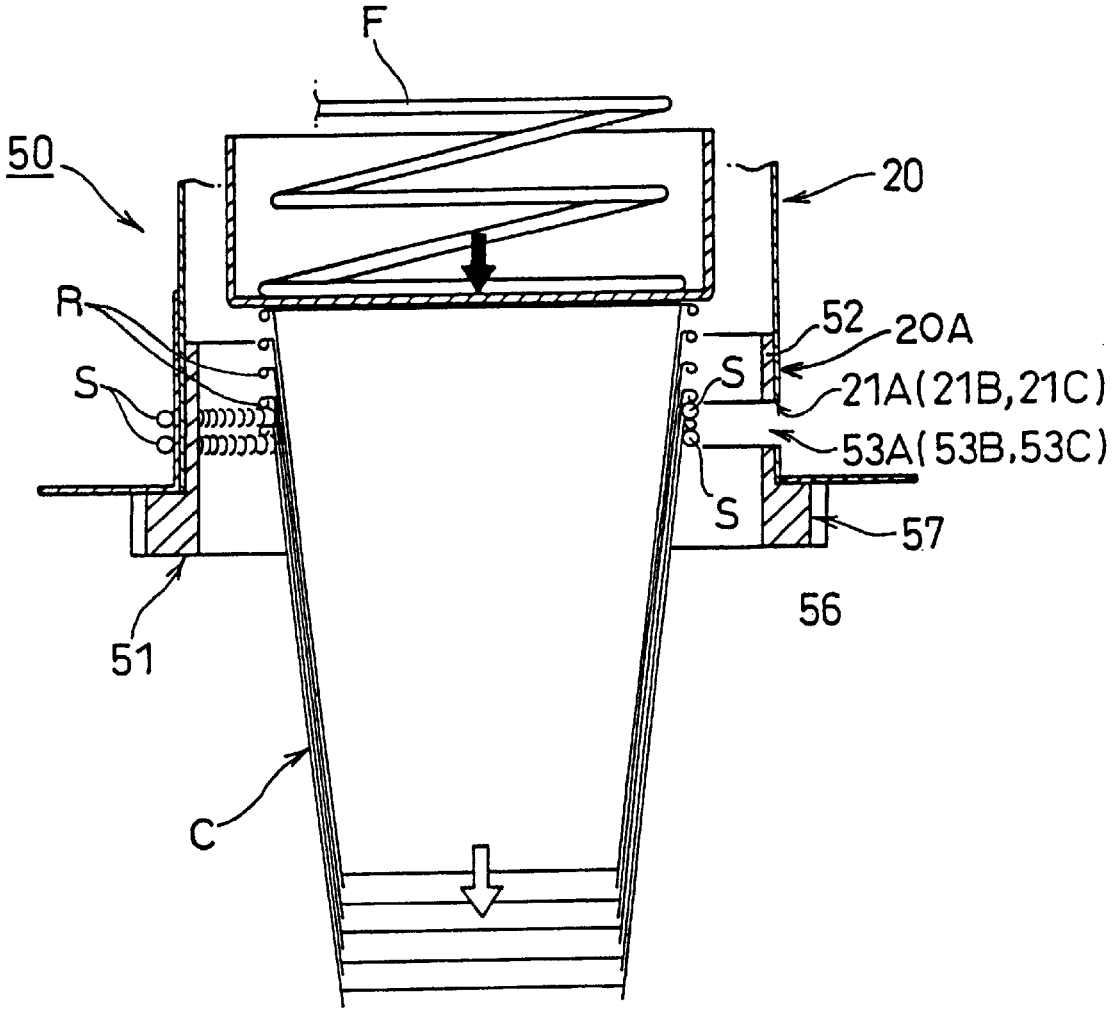
FIG. 11 is a cross-sectional view showing an engagement state of the inner cylinder and the outer cylinder which are composing said cup dispenser.
Figure 12:
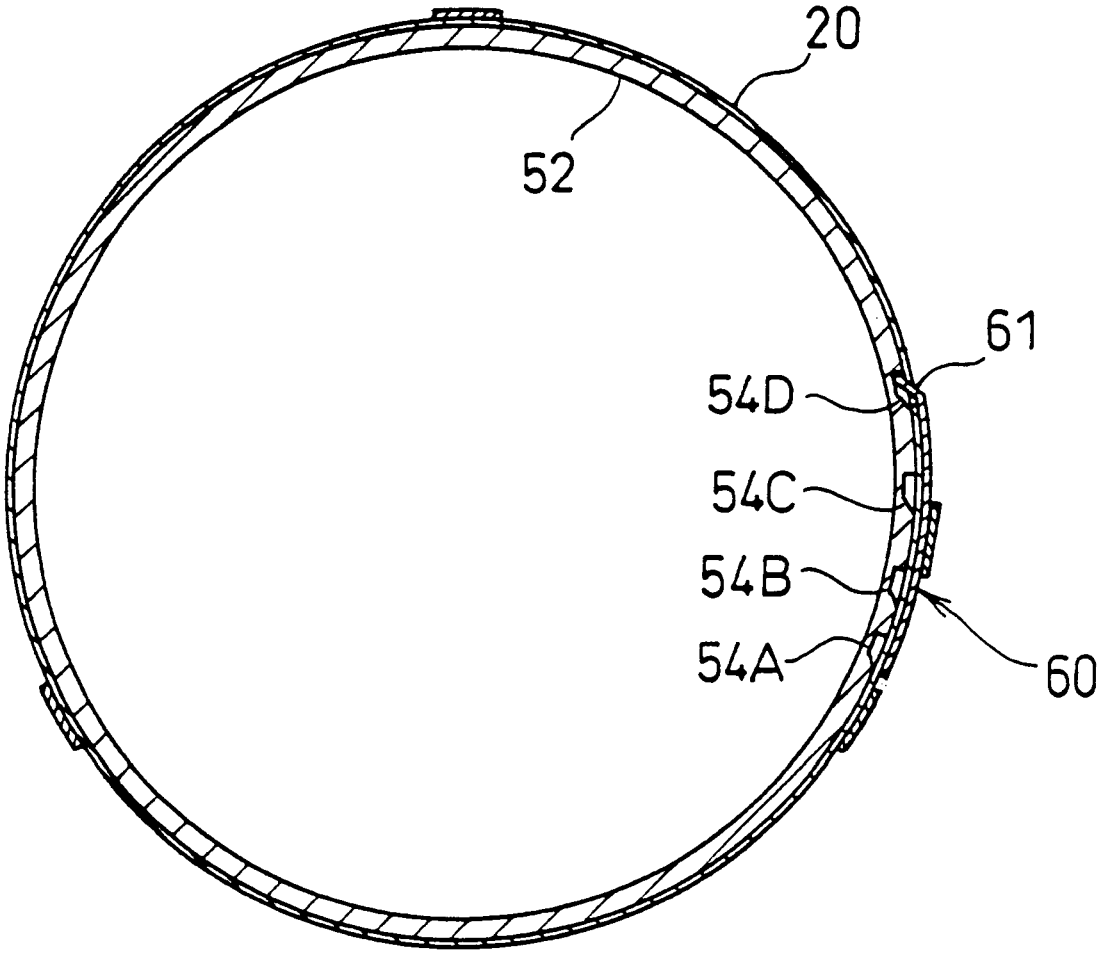
FIG. 12 is an enlarged cross-sectional view of a particular portion showing a hooking state of the inner cylinder and the outer cylinder which are composing said cup dispenser.
Figure 13:
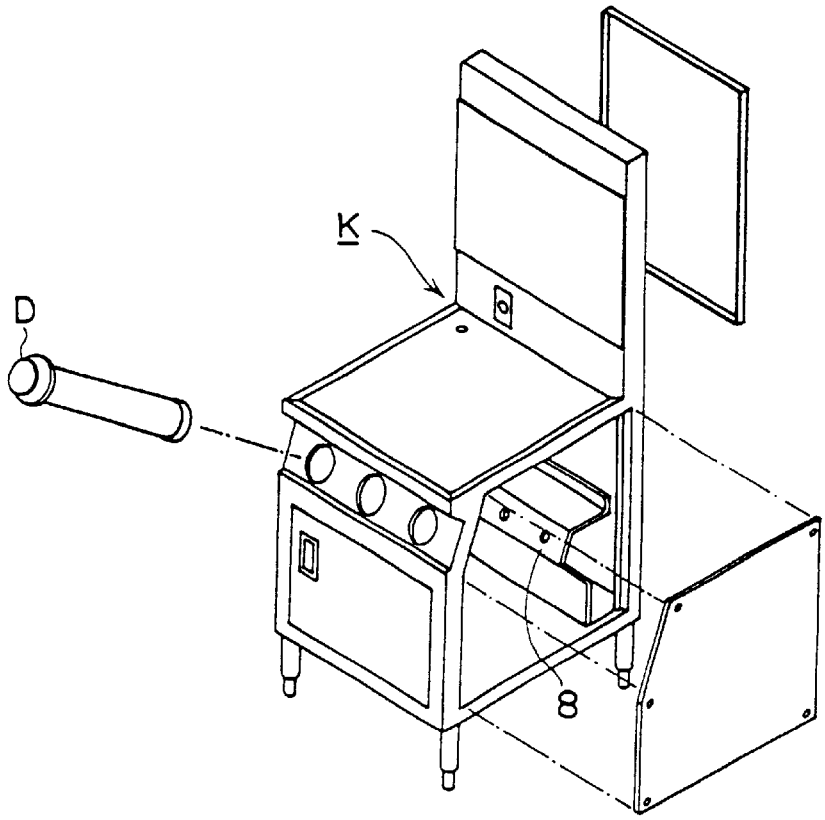
FIG. 13 is a decomposed perspective view of a cabinet which obtains a cup dispenser.
Figure 14:
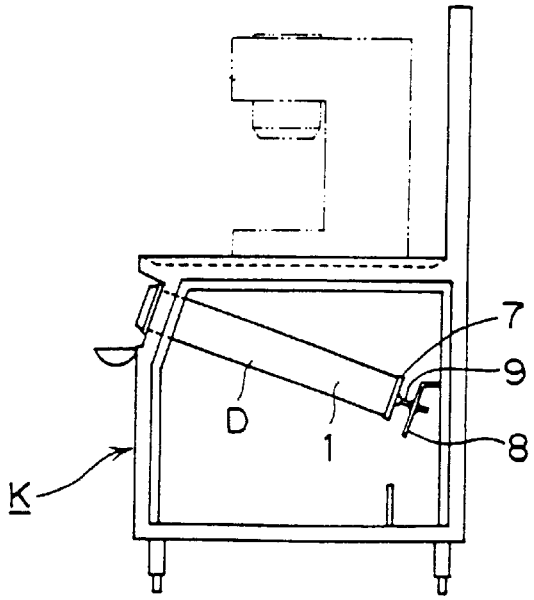
FIG. 14 is a cross-sectional side view of said cabinet.
Figure 15:
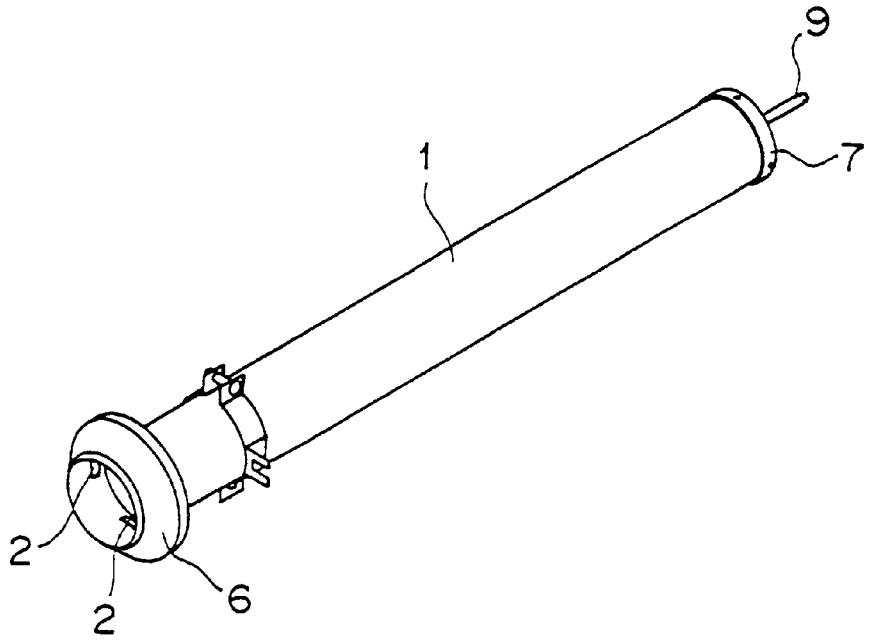
FIG. 15 is a perspective view of an entire cup dispenser.
Figure 16:
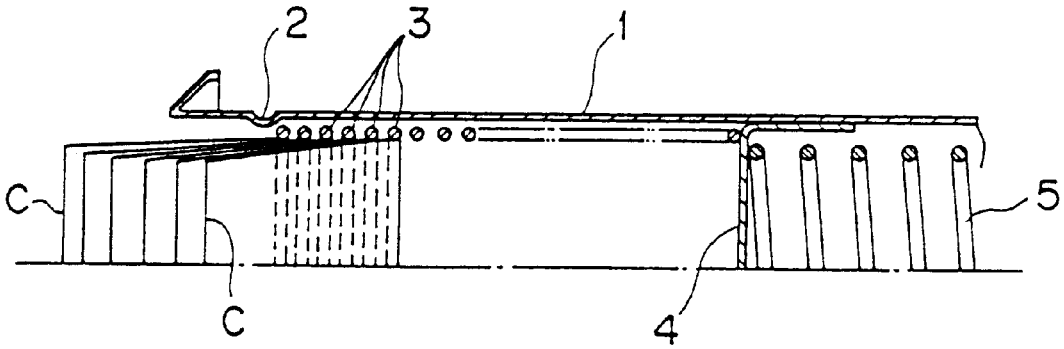
FIG. 16 is a cross-sectional view of the upper half of a particular portion showing a composition of conventional cup dispenser.

Also, cups stacked in said outer cylinder 20 are held as being pressed toward the outlet direction in an ordinary state by a natural force of a spring F shown in FIG. 11. Furthermore, the opposite end of the cup-outlet end of said outer cylinder 20, which is not shown in figures, is covered with a lid with a rod to fasten the cylinder on a supporting part provided inside of a cabinet in the same manner as conventional-cup dispensers.

Since the inner cylinder 51 of the cup dispenser 50 related to this embodiment is to be made of a synthetic resin as explained above, it can be easily formed, and its production cost can be largely reduced.

Also, since the inner cylinder 51 is made of a synthetic resin, the springs SA and SB will not bite the cup grooves 54A, 54B, 54C and 54D, and, as a result, sizes can be easily changed with a small force.

Furthermore, since the nonskid concave-convex surface 57 is formed along the perimeter of the flange 56 at the cup-outlet end of the inner cylinder 51 in this embodiment, the turning operation of the inner cylinder 51 can be performed safely and easily.

POSSIBLE INDUSTRIAL USES

Since the cup dispenser related to the present invention is composed to have a stopper means to adjust with any sizes of cups to be stored as explained above, changing of cylinders is no longer necessary to meet with different sizes of cups in such cup dispenser; therefore it offers tremendous advantages in terms of user-friendliness and effectiveness.

Furthermore, in the present invention, the production cost is reduced by preventing the biting of springs effectively, and at the same time, it offers further efficiency because of the useful means for users to easily recognize a status of cup setting.

What is claimed is:

1. A cup dispenser comprising an outer cylinder where cups are stored, an inner cylinder which is projected in a cup-outlet end of the outer cylinder and a spring mounted on said outer cylinder, said spring being formed to elastically touch an opening rim of a cup stored in the outer cylinder in more than one location along a perimeter of the opening rim.

2. A cup dispenser as claimed in claim 1, wherein a body of the inner cylinder has slits along a perimeter of said inner cylinder body at predetermined intervals and a body of the outer cylinder has slits along a perimeter of said inner cylinder body at predetermined intervals, each of the slits of said outer cylinder being placed to share a same center with each of the slits of said inner cylinder; and wherein the inner cylinder is rotatably projected in the outer cylinder, and the elastic spring formed in an endless shape is mounted along the outside perimeter of the outer cylinder so as to be projected in each of the slits, the projection amount of spring inward to the inner cylinder being regulated by turning the inner cylinder.

3. A cup dispenser as claimed in claim 2, wherein pawls are projected from the body of the inner cylinder, and guide grooves for said projected pawls to slide in are provided in the body of the outer cylinder.

4. A cup dispenser as claimed in claim 1, wherein the spring consists of a plurality of slender coils which are set to form a ring.

5. A cup dispenser as claimed in claim 1, wherein the outer cylinder is provided with pullout paws along a perimeter of a cup-outlet side of said outer cylinder, and said pullout paws are pushed inward of the outer cylinder by a force of a spring held by a holder cylinder which is to be engaged with an outside of the outer cylinder.

6. A cup dispenser as claimed in claim 1, wherein the outer cylinder is formed of a metallic material the inner cylinder is made of a joint-free synthetic resin, a plurality of cup size grooves are etched along a perimeter of a body of the inner cylinder, and a spring stopper is mounted on the outer cylinder, said stopper having a free end to be hooked in said cup size grooves, while a flange provided at a cup-outlet end of the body of the inner cylinder has an indication to indicate several cup sizes.

7. A cup dispenser as claimed in claim 1, wherein a concave-convex surface is provided as a grip around a flange at a cup-outlet side of the inner cylinder, said inner cylinder being made of a synthetic resin.

8. A cup dispenser as claimed in claim 2, wherein the spring consists of a plurality of slender coils which are set to form a ring and to fit with the slits of the outer cylinder body and the slits of the inner cylinder body.

9. A cup dispenser as claimed in claim 3, wherein the spring consists of a plurality of slender coils which are set to form a ring and to fit with the slits of the outer cylinder body and the slits of the inner cylinder body.

10. A cup dispenser comprising an outer cylinder where cups are stored, an inner cylinder which is projected in a cup-outlet end of the outer cylinder and a spring mounted on said outer cylinder, said spring being formed to elastically touch opening rims of cups stored in the outer cylinder, wherein a body of the inner cylinder has slits along a perimeter of said inner cylinder body at predetermined intervals and a body of the outer cylinder has slits along a perimeter of said inner cylinder body at predetermined intervals, each of the slits of said outer cylinder being placed to share a same center with each of the slits of said inner cylinder;

and wherein the inner cylinder is rotatably projected in the outer cylinder, and the elastic spring formed in an endless shape is mounted along the outside perimeter of the outer cylinder so as to be projected in each of the slits, the projection amount of spring inward to the inner cylinder being regulated by turning the inner cylinder.

11. A cup dispenser as claimed in claim 10, wherein pawls are projected from the body of the inner cylinder, and guide grooves for said projected pawls to slide in are provided in the body of the outer cylinder.

* * * * *